United States Patent [19]

Allen

[11] 4,078,793

[45] Mar. 14, 1978

[54] PORTABLE APPARATUS FOR DELINEATING A PLAYING AREA

[76] Inventor: William P. Allen, P.O. Box 702, Portland, Oreg. 97207

[21] Appl. No.: 574,825

[22] Filed: Jul. 25, 1975

[51] Int. Cl.[2] ..... A63H 33/08

[52] U.S. Cl. ..... 273/1 A; 46/28

[58] Field of Search ..... 273/1 A, 1 B; 272/3, 272/109; 46/25, 27, 28, 29, 30, 31; 52/588, 656

[56] References Cited

U.S. PATENT DOCUMENTS

| | | | |
|---|---|---|---|
| 1,718,230 | 6/1929 | Graves | 46/29 |
| 1,766,022 | 6/1930 | Graves | 46/29 |
| 2,112,474 | 3/1938 | Warren | 46/31 X |
| 2,354,485 | 7/1944 | Slaughter | 46/30 UX |
| 2,388,297 | 11/1945 | Slaughter | 46/30 UX |
| 2,712,200 | 7/1955 | Dearling | 46/28 |
| 3,515,385 | 6/1970 | Gunderson | 273/1 A |
| 3,550,311 | 12/1970 | Fouquart | 46/28 |
| 3,570,169 | 3/1971 | Jacob | 46/31 X |
| 3,768,809 | 10/1973 | Ciarfello | 273/1 A |

FOREIGN PATENT DOCUMENTS

| | | | |
|---|---|---|---|
| 747,860 | 4/1933 | France | 46/28 |
| 1,580,113 | 7/1969 | France | 46/25 |
| 488,335 | 1/1930 | Germany | 46/31 |
| 564,707 | 11/1932 | Germany | 46/28 |
| 846,370 | 8/1960 | United Kingdom | 46/28 |
| 1,229,291 | 4/1971 | United Kingdom | 46/28 |

*Primary Examiner*—William H. Grieb

*Assistant Examiner*—Arnold W. Kramer

*Attorney, Agent, or Firm*—Kolisch, Hartwell, Dickinson & Stuart

[57] ABSTRACT

Portable apparatus for delineating a playing area including a plurality of elongate members of appropriate length for defining sides of the area. One pair of the members are channels which have ends cut to the form of blunted arrowheads. Another pair of the members, referred to as side members, have apertures extending therethrough adjacent their ends adapted to receive the arrowhead ends of the channels therethrough with the diverging lugs on the ends of the channels releasably locking the channels to the side members in desired angular relationship. One of the side members has an enlarged coupling head extending therealong and the other side member has a coupling groove extending therealong adapted frictionally to receive and hold a coupling head therein. Adjacent frames formed by the interconnection of the members may be releasably connected to each other by insertion of a coupling head on a side member of one frame into the coupling groove of a side member on another frame. The members are initially formed as an extrusion with the members interconnected in the extrusion through bendable connectors whereby they may be folded over each other, with the coupling head of one of the side members received in the coupling groove on another of the side members, to provide a compact package for storing and transport.

4 Claims, 10 Drawing Figures

PORTABLE APPARATUS FOR DELINEATING A PLAYING AREA

BACKGROUND AND SUMMARY OF THE INVENTION

This invention pertains to portable apparatus for delineating playing areas.

In the playing of various games, such as hopscotch and other games, it is necessary to delineate playing areas. In the past, various apparatus has been developed in an attempt to provide a portable assembly for delineating such areas. Such previous devices, however, have not been altogether satisfactory, in that they often have been heavy and unwieldy, or they have required cumbersome techniques in connecting and disconnecting members in the assembly, or have had insufficient stability to provide a frame which holds its desired shape throughout play.

A general object of the present invention is to provide novel portable apparatus for delineating playing areas which overcomes the disadvantages of prior devices in an inexpensive and simple manner.

More particularly, an object of the invention is to provide novel portable apparatus for delineating playing areas including a plurality of elongate members, each of an appropriate length to define a side of the area and including connecting means for connecting the members to each other in desired angular relationship. The connecting means includes an aperture extending laterally through one of the members adapted to receive an end portion of another of the members and automatically engageable catch means for releasably securing the members against disconnection from each other. In the embodiment illustrated the catch means includes apertures in upstanding portions of elongate side members and blunted arrowhead-like configurations on end portions of cross, or end, members which are received through the apertures. Diverging sides of the arrowhead configurations are compressed on insertion through the apertures and expand to inhibit release of the members after passing through the apertures.

Another object is to provide novel apparatus for delineating playing areas in which novel coupling means are provided for connecting adjacent frames together to form an interconnected pattern of playing areas.

A still further object of the invention is to provide a novel break-apart assembly having parts therein, which when separated provide the elongate side and end members referred to above for interconnection to produce a playing area.

Yet another object is to provide a break-apart assembly for providing such members, wherein the members are interconnected through bendable and severable connectors whereby the members may be folded over each other with couplings thereon engaging each other to provide a compact and sturdy package for storing or transport.

DRAWINGS

These and other objects and advantages will become more fully apparent as the following description is read in conjunction with the drawings wherein.

DETAILED DESCRIPTION OF AN EMBODIMENT OF THE INVENTION

Figures 1, 2, 3, 4, 5, 6, 7, 8, 9, 10:
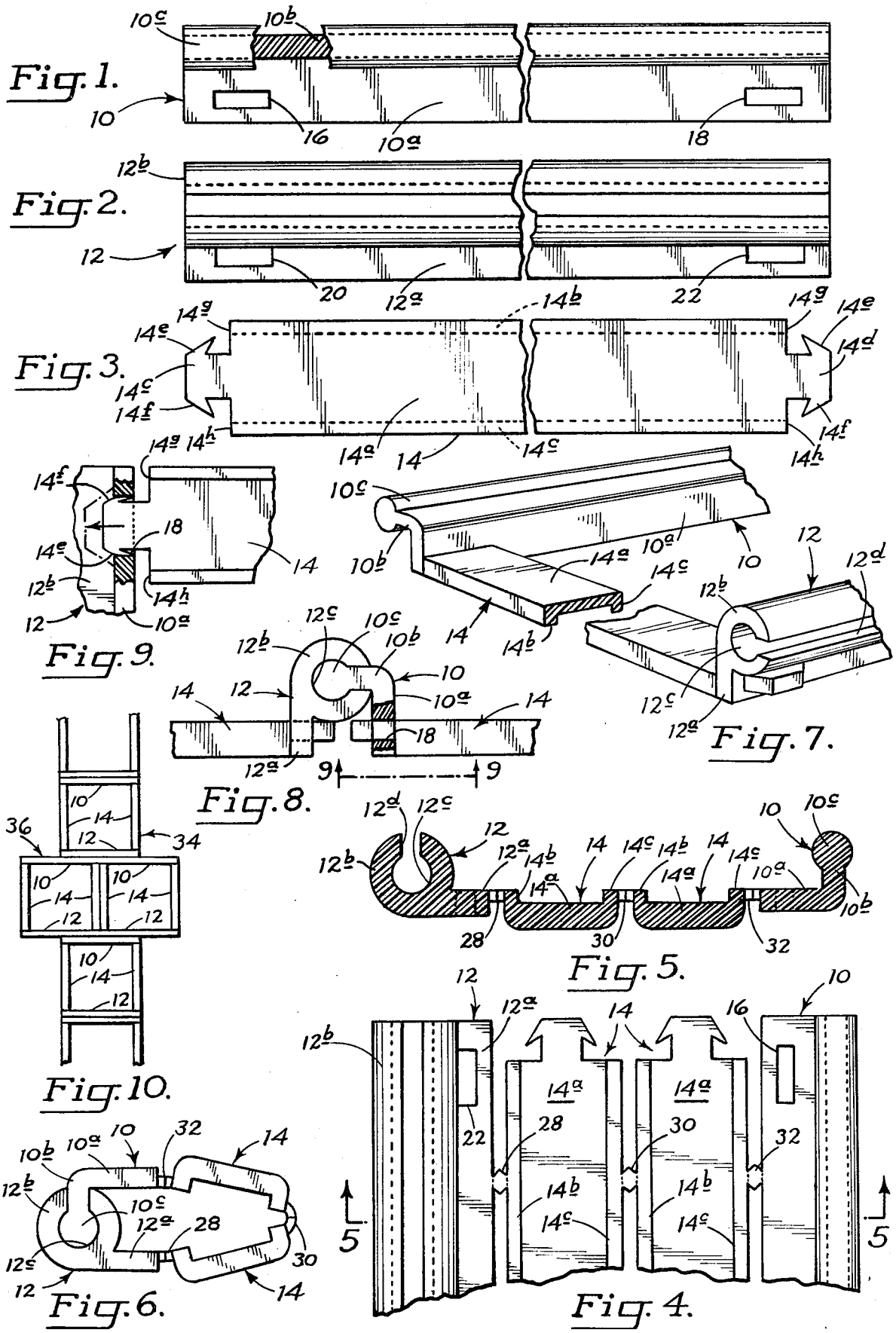
FIG. 1 is a side elevation view of an elongate side member in the apparatus.
FIG. 2 is a side elevation view of another side member in the apparatus.
FIG. 3 is a top plan view of a channel-shaped end, or cross, member in the apparatus.
FIG. 4 is a top plan view of a formed extrusion after cutting to produce members as illustrated in FIGS. 1–3.
FIG. 5 is a cross-sectional view taken generally along the line 5—5 in FIG. 4.
FIG. 6 is an end view of the extrusion of FIGS. 4 and 5 folded over and interconnected for storage or transport.
FIG. 7 is a perspective view of an end portion of a frame formed by interconnection of side and end members in the apparatus, with portions broken away.
FIG. 8 is an enlarged end view of a pair of frames formed by the apparatus interconnected for use.
FIG. 9 is a bottom view of an interconnection between a side member and an end, or cross, member, at an intermediate point in insertion for connection.
FIG. 10 is a plan view, on a reduced scale, illustrating how a plurality of frames constructed according to the invention may be interconnected to produce a pattern of playing areas for use.

Referring to the drawings, at 10 is indicated generally a first elongate side member in the apparatus, at 12 is indicated a second elongate side member in the apparatus and at 14 are indicated channel-shaped end, or cross, members. The side and cross members are adapted for interconnection with each other in desired angularly disposed relationship, as will be described in greater detail below, to form substantially rectangular frames for delineating playing areas.

Describing side member 10, and referring to FIGS. 1, 7 and 8, the member is an elongate angle section having ribs, or flanges, **10*a*, 10*b* disposed substantially normal to each other. An elongate coupling head 10*c* having a substantially circular cross section when viewed along a line extending longitudinally of member 10 is connected to an outer edge margin of rib 10*b* and extends the full length of the member. A pair of rectangular apertures 16, 18 are defined in flange 10*a*** adjacent opposite ends of the member.

Describing member 12, it includes an elongate rib, or flange, section **12*a* and a substantially circular, elongate coupling portion 12*b* extending along one edge of portion 12*a*. As is best seen in FIGS. 5, 6, 7 and 8, portion 12*b* has an elongate coupling groove 12*c* formed therein. The inner portion of groove 12*c* is substantially circular and has a diameter of a size for frictionally receiving and holding a coupling head 10*c* therein, and opens through a straight slot 12*d* to the outer surface of portion 12*b*. Slot 12*b* is of a size to receive rib 10*b* of member 10 as best seen in FIGS. 6 and 8**.

Member 12 also has substantially rectangular apertures 20, 22 extending therethrough adjacent its ends similar to apertures 16, 18 previously described in regard to member 10. As is seen in FIGS. 1 and 2 apertures 16, 18, 20, 22 are spaced substantially equal distances from their associated ends of members 10, 12 and are spaced substantially equal distances above the lower edge margins of the members.

Describing an end, or cross member, 14 and referring specifically to FIGS. 3 and 7, such member includes an elongate channel section having a substantially flat web **14*a* from which laterally spaced flanges 14*b*, 14*c* extend in a substantially common direction. The outer end portions of flanges 14*b*, 14*c* are cut away at opposite ends of the member and the opposite ends of web 14a are formed in the substantially blunted arrowheadlike configuration illustrated in FIG. 3. As is seen, incompressible end, or connecting portions 14c, 14d of the web extend outwardly at opposite ends of the member and have laterally spaced, opposed, compressible-expandable lugs 14e, 14f projecting outwardly from opposite sides of end portions 14c, 14d. Lugs 14e, 14f at each end of the cross member diverge on progressing longitudinally inwardly from their respective ends of the member and are relieved on their sides facing their associated end portions of the web, with the lugs being compressible whereby they may be forced through one of apertures 16–22**.

As is seen in FIG. 9, where a member 14 is illustrated being connected to member 10, an end portion of member 14 may be inserted longitudinally through aperture 18 in the direction of the arrow in FIG. 9. As the end portion of member 14 is shoved through the aperture, lugs 14e, 14f compress to pass therethrough. At such time as they pass fully through the aperture they expand to the position illustrated in dashed outline to engage the opposite side of rib 10a to inhibit disconnection of the members. In this connected position, the substantially squared off end margins 14g, 14h of member 14 engage one side of rib 10a to establish a predetermined angular relationship between the members and hold them in such position. To release the members from each other, it is a simple matter merely to manually compress lugs 14e, 14f to permit retraction of the member 14 through bore 18 in member 10. Similar connection and disconnection of a member 14 to member 12 is possible also.

Referring to FIGS. 4 and 5, a break-apart assembly of two channel members 14, and members 10 and 12 for producing a single rectangular frame is illustrated. The members initially are produced by extruding or injecting molding plastic to form an elongate element, or extrusion, having the general cross-sectional configuration illustrated in FIG. 5. In such extrusion, flange 12a and flange 14b of one channel member are interconnected by a connector strip 28. Adjacent flanges 14b, 14c of side-by-side channels 14 are interconnected by a strip 30. Rib 10a and flange 14c on one of the channels are interconnected by a connector strip 32. As is seen in FIG. 5, connector strips 28, 30, 32 are of thinner cross section than the flanges which they interconnect. After an elongate element, or extrusion, has thus been formed, the same is cut into a common length wherein each member is of an appropriate length to define a side of the area to be delineated by the apparatus. At the same time as the extrusion is cut to length, dies also may cut the blunted arrowhead-shaped ends on sections 14. Other dies may cut apertures 16, 18, 20 and 22 and can cut away all but minor portions of connector strips 28, 30, 32 to leave only small segments of such strips as illustrated in FIG. 4. The segments of strips 28, 30, 32 which remain have a degree of flexibility which permits bending, as illustrated for strip 30 in FIG. 6, and the strip portions are severable to permit separation of the members for use.

With such an assembly of parts, the same may be folded over about connector strip portions 30 to the position illustrated in FIG. 6 wherein coupling head 10c may fit within groove 12c to form a compact and sturdy package for storing and transport.

At such time as it is desired to use the members to delineate an area, they are merely separated at connector elements 28, 30, 32 to provide the individual members as illustrated in FIGS. 1, 2 and 3. Side members 10, 12 are disposed parallel to each other, and end, or cross members, 14 are connected thereto spanning the space between opposite sets of ends of the side member as illustrated for one end of a frame in FIG. 7 to form a rectangular frame as indicated generally at 34 in FIG. 10. Assembly is accomplished as previously described, by inserting the ends of members 14 through the apertures in side members 10, 12 as illustrated in FIG. 9 with lugs 14e, 14f compressing as they pass through the apertures and then expanding as they reach the opposite side of the side member to secure the end members to the side members.

Similar sets of end members and side members as described herein may be assembled to form other rectangular frames as illustrated generally at 36, 38, 40 in FIG. 10. Adjacent frames may be connected as illustrated in FIG. 8 by inserting coupling head 10c on a member 10 in one of the frames in the coupling groove 12c of a member 12 in an adjacent frame. In this way, multiple frames can be interconnected in a desired pattern to form a playing area, such as a hopscotch game.

As is best seen in FIG. 8, the apertures in members 10, 12 are spaced a preselected distance above the lower edge margins of these members and the end portions of members 14 which fit therethrough are spaced a like distance from the lower edge margins of their associated members. In this manner, the lower edge margins of all of the members lie in a substantially common plane to provide a stable base for the unit which rests flat on an underlying surface.

To disassemble the unit, it is an easy matter merely to manually squeeze, or compress, lugs 14e, 14f on a member 14 together, whereby the same may be retracted from its associated aperture in a side member to disassemble the frame. The disassembled frame then may compactly stored for future use.

While a preferred embodiment of the present invention has been described herein, it should be apparent to those skilled in the art that variations and modifications are possible without departing from the spirit of the invention.

It is claimed and desired to secure by letters patent:

1. A break-apart assembly for providing portable apparatus for delineating a playing area, said assembly comprising an elongate element including a pair of elongate channel sections, each having a substantially flat web and upstanding laterally spaced flanges projecting outwardly in a common direction from the web, an elongate angle section having an elongate upstanding rib extending longitudinally therealong and having an elongate coupling head of greater side-to-side thickness than said rib extending longitudinally along an edge of said rib, an elongate angled coupling section having an elongate upstanding coupling portion with an elongate groove defined therein extending longitudinally therealong of such configuration as to frictionally receive and hold said coupling head therein, and bendable connectors interposed between said sections and connecting them together with said channel sections side-by-side and parallel, with said connectors being severable to permit separation of said sections, said angle section connected to an outer flange of one of said channel sections and said coupling section connected to the outer flange of the other channel section, said sections all extending substantially parallel to each other, and said connectors accommodate swinging of said angle section and one of said channel sections over the other channel section and coupling section for insertion of said coupling head in said groove to provide a compact package, said angle section and coupling section having apertures formed therein adjacent their opposite sets of ends, and opposite ends of said channel sections being formed in blunted arrowhead configurations with diverging sides thereof compressible for insertion through one of said apertures when said sections are separated and on passing therethrough expansible to inhibit removal from said aperture.

2. Portable apparatus for delineating a playing area comprising at least a pair of elongate side members and at least a pair of elongate end members, each of appropriate length to define a side of said area, each of said side members including a substantially upright flange extending longitudinally therealong and having an aperture defined in such flange spaced a preselected distance from the elongate lower edge thereof, and each of the opposed ends of an end member bears a connecting portion which is constructed to extend through an aperture in a side member and is spaced a distance above the elongate lower edge of said end member equal to said preselected distance, said end member comprising limit means thereon for engaging a side of a side member to limit the extension of said connecting portion through said aperature to a position in which said connecting portion projects a preselected distance outwardly from the opposite side of said side member, and automatically engageable catch means for releasably securing said connecting portion against removal from said aperture when received therein, said catch means comprising a laterally extensible-contractible lug on said connecting portion which in its extended position is operable to engage said opposite of said side member to inhibit separation of said members and is manually compressible to a position permitting removal of said connecting portion from said aperture.

3. The apparatus of claim 2, wherein said connecting portion of an end member has the configuration of a blunted arrowhead having laterally extending, opposed, compressible lugs which in their normally noncompressed state have a side-to-side dimension greater then the side-to-side dimension of said aperture and are compressible to permit passage of said connecting portion through said aperture.

4. The apparatus of claim 2, wherein each end member comprises a channel including an elongate, substantially flat web and laterally spaced flanges projecting outwardly in a common direction therefrom, and in the region of said end portion of said member said flanges are cut away with a section of said web forming said end portion of the end member adapted to extend through said aperture.

* * * * *